US005496169A

United States Patent [19]

Chen

[11] Patent Number: 5,496,169

[45] Date of Patent: Mar. 5, 1996

[54] SAFETY CONTROL SWITCH FOR GAS-FIRED IGNITION GUNS

[76] Inventor: Tung-Yu Chen, 3 Fl., No. 174, Tzu Chiang St., Taipei City, Taiwan

[21] Appl. No.: 438,362

[22] Filed: May 10, 1995

[51] Int. Cl.[6] ..... F23D 11/36

[52] U.S. Cl. ..... 431/153; 431/255; 431/256

[58] Field of Search ..... 431/153, 255, 431/256

[56] References Cited

U.S. PATENT DOCUMENTS 3,155,140 11/1964 Wilson ..... 431/153

4,273,528 6/1981 Gobelt ..... 431/255

5,412,179 5/1995 Lin-Tien Cheh ..... 431/256

*Primary Examiner*—Carroll B. Dority

*Attorney, Agent, or Firm*—Bacon & Thomas

[57] ABSTRACT

A safety control switch including a push button ignition switch, which consists of a slide, a push button, a compression spring, a brake block, and a contact metal spring plate, for controlling gas flow and igniter in a gas-fired ignition gun, and a locking device mounted on the housing of the gas-fired ignition gun and moved relative to the brake block of the push button ignition switch between a first position to stop the push button and the slide from operation and a second position to let the push button and the slide be operated.

3 Claims, 4 Drawing Sheets

SAFETY CONTROL SWITCH FOR GAS-FIRED IGNITION GUNS

BACKGROUND OF THE INVENTION

The present invention relates to a safety control switch for gas-fired ignition guns, which can be operated to produce sparks as well as to make a flame, and which has a locking device for locking the ignition switch from operation.

Various gas-fired apparatus are known and intensively used for soldering or igniting things. Exemplars are seen in U.S. Pat. No. 4,688,522 entitled "GAS-FIRED SOLDERING IRON"; U.S. Pat. No. 5,215,456 entitled "GAS COMBUSTION METHOD AND APPARATUS"; U.S. Pat. No. 4,920,952 entitled "HEAT PROCESSING APPARATUS USING LIQUEFIED GAS". These apparatus teach the use of fuel gas for soldering or igniting things. U.S. patent application Ser. No. 08/107085 entitled "Push button ignition switch for controlling gas flow and igniter in an ignition gun", filed on Oct. 17 1993, now allowed as U.S. Pat. No. 5,412,179, teaches the use of a push button ignition switch to control the operation of the ignition gun for producing sparks and flame. This structure of push button ignition switch is functional, however it still has a drawback. Because the push button ignition switch is not locked when the ignition gun is not in use, the push button ignition switch may be triggered by an error, causing the ignition gun to produce sparks.

SUMMARY OF THE INVENTION

The present invention has been accomplished to provide a safety control switch which eliminates the aforesaid problem. According to the present invention, a locking device is mounted on the housing of the gas-fired ignition gun and moved relative to the push button ignition switch between a first position to stop the push button ignition switch from operation and a second position to let the push button ignition switch be operated.

DETAILED DESCRIPTION OF THE PREFERRED EMBODIMENT

Figure 1:
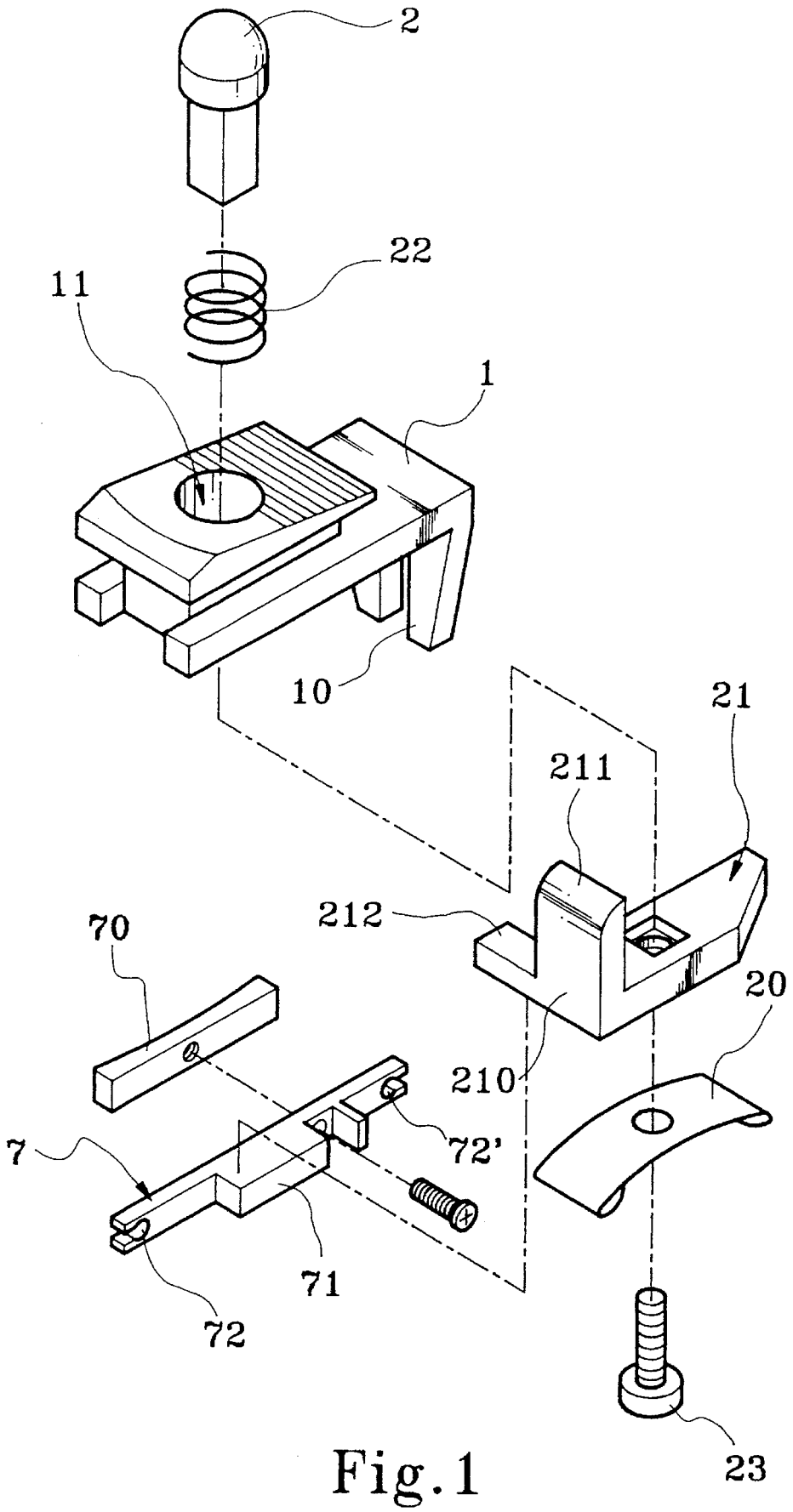
FIG. 1 is an exploded view of a safety control switch according to the present invention.
Figure 2:
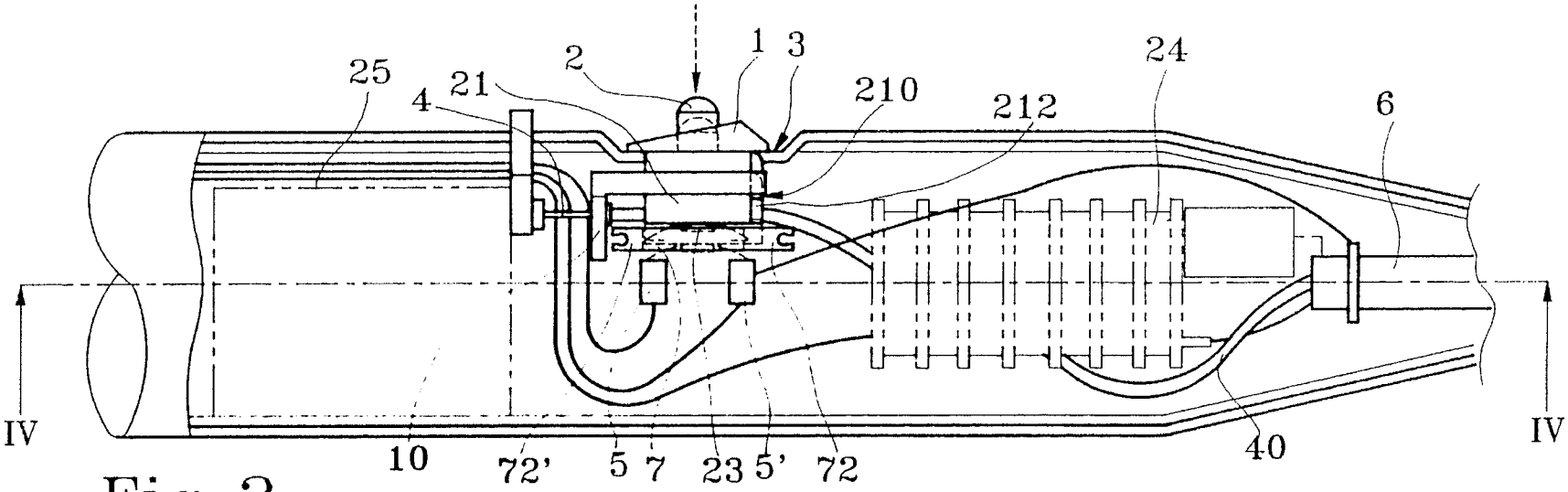
FIG. 2 is an installed view showing the safety control switch installed in a track on the housing of the ignition gun.
Figure 3:
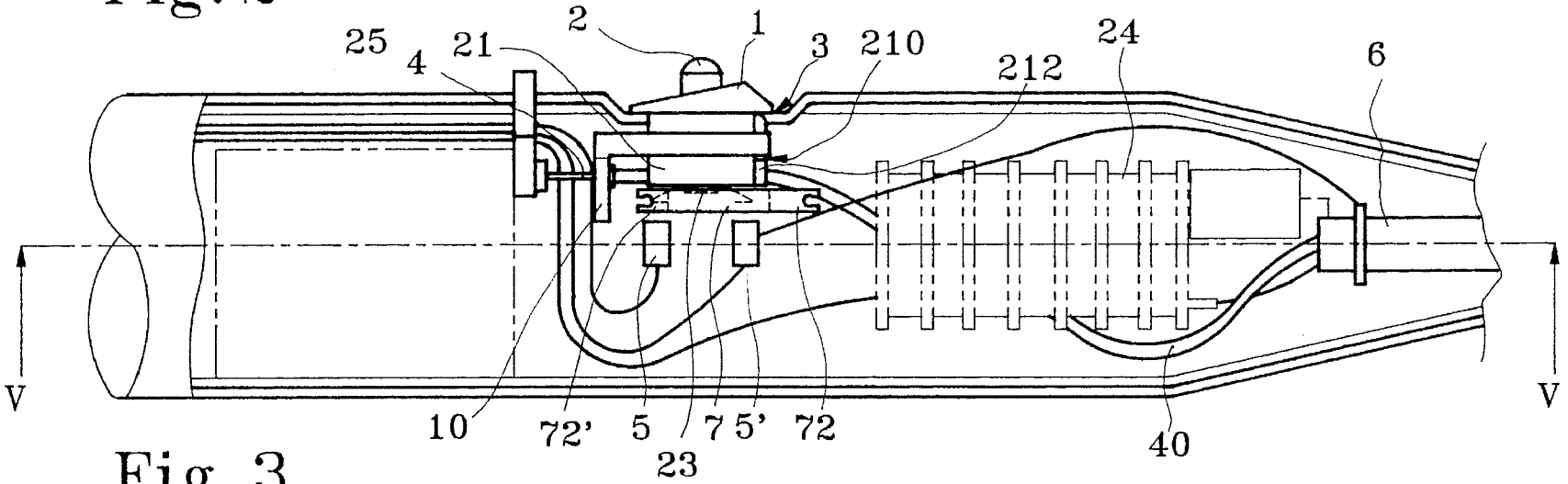
FIG. 3 is similar to FIG. 2 but showing the push button locked.
Figure 6:
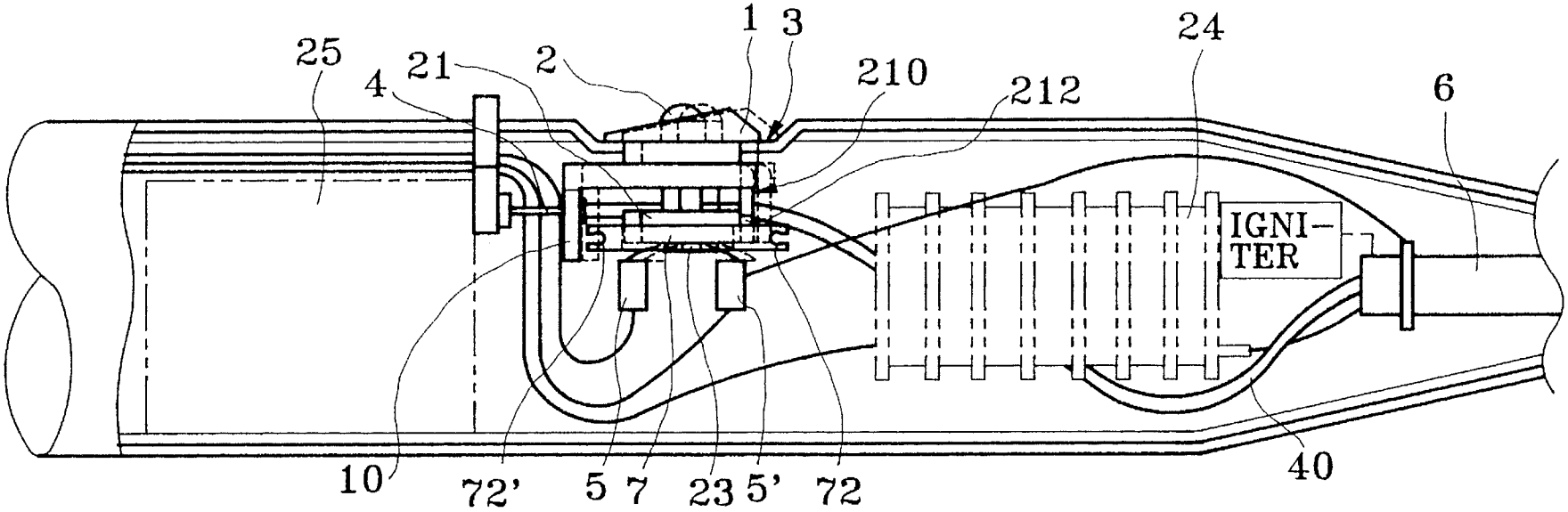
FIG. 6 is similar to FIG. 2 but showing the push button depressed and the slide moved.

Referring to FIGS. 1 and 2, a safety control switch for gas-fired ignition gun in accordance with the present invention comprises a slide 1 mounted in a track 3 on the housing of a gas-fired ignition gun. When the slide 1 is moved in the track 3 forwards to a predetermined distance, the gas nozzle 4 of the gas-fired ignition gun is driven by the forked tail 10 of the slide 1 to release a flow of fuel gas from the gas tank, referenced by 25, to the flame nozzle (not shown) through a gas pipe 40. The slide 1 is mounted with a push button 2. The push button 2 is supported on a compression spring 22 within a through hole 11 on the slide 1. The bottom end of the push button 2 extends out of the through hole 11 and screwed up with screw 23 to hold a contact metal spring plate 20 and a brake block 21. The brake block 21 is retained between the contact metal spring plate 20 and the slide 1. When the push button 2 is not depressed, it is forced upwards to the upper limit position by the compression spring 22 (see the real line in FIG. 2), and the contact metal spring plate 20 is separated from the contacts 5 and 5' at the two opposite terminals of the ignition circuit of the gas-fired ignition gun. At the same time, the upright stop rod 210 of the brake block 21 inserted into the track 3 to stop the slide 1 from moving. Therefore, the gas-fired ignition gun does no work. When the push button 2 is depressed, the high-tension winding 24 of the gas-fired ignition gun is triggered to produce sparks for ignition. After the push button 2 is depressed, the stop rod 210 of the brake block 21 is released from the track 3 (see the imaginary line in FIG. 2), therefore the slide 1 can be moved forwards to release fuel gas for burning by sparks (see also FIG. 6). Therefore, the safety control switch can be controlled to produce sparks as well as to produce a flame. Furthermore, the stop rod 210 has a smoothly curved stop side 211, which imparts a return force to the slide 1 to prevent continuous releasing of fuel gas.

Figure 4:
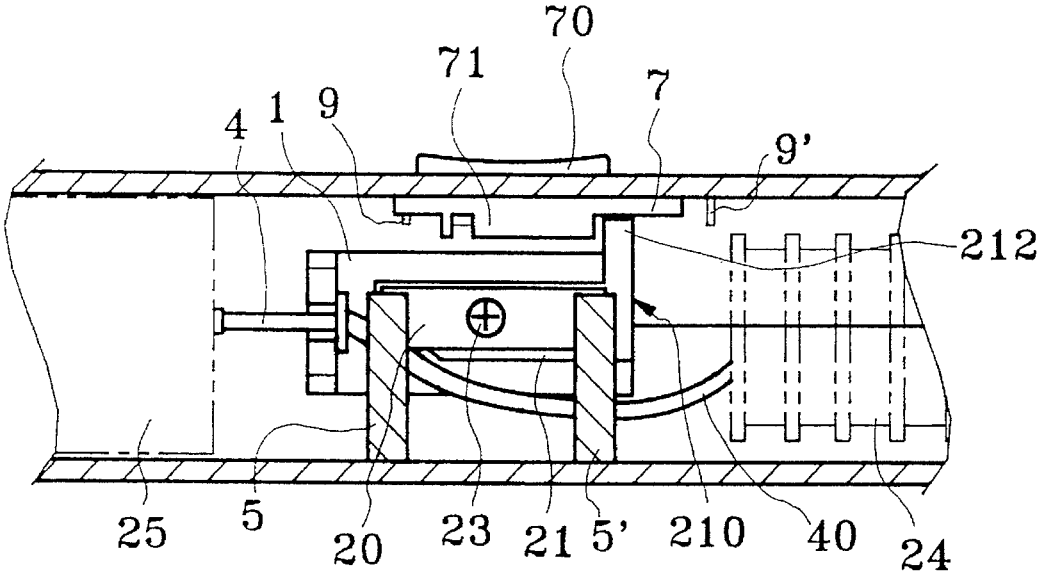
FIG. 4 is a sectional view taken along line IV—IV of FIG. 2.
Figure 5:
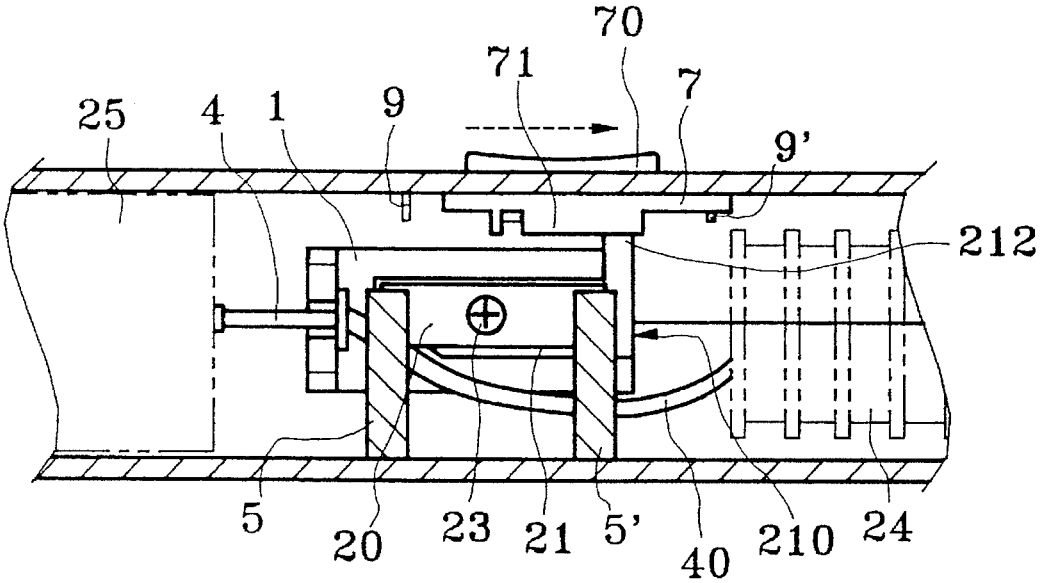
FIG. 5 is a sectional view taken along line V—V of FIG. 3.

Referring to FIGS. from 2 to 5 and FIG. 1 again, the brake block 21 further comprises a horizontal stop rod 212 perpendicularly extended from the upright stop rod 210 at one side to act with a locking device 7. The locking device 7 comprises a locking block 71 and a finger rod 70 for moving the locking block 71 by hand. When the locking device 7 is moved to the locking position, the locking block 71 is stopped against the horizontal stop rod 212 to stop the push button 2 from operation. The locking device 7 is mounted in the housing of the gas-fired ignition gun at one side and moved back and forth between the locking position and the unlocking position. As illustrated, the locking block 71 of the locking device 7 has two slots 72 and 72' at two opposite ends loosely matched with two pins 9 and 9' on the housing of the gas-fired ignition gun. Therefore, the locking device 7 can be moved relative to the pins 9 and 9' between the locking position and the unlocking position. When the locking device 7 is moved leftwards to the unlocking position, the locking block 71 is released from the horizontal stop rod 212 (see FIGS. 2 and 4), the push button 2 can be depressed to produce sparks and the slide 1 can be moved forwards to release fuel gas. When the locking device 7 is moved rightwards to the locking position, the locking block 71 is stopped against the horizontal stop rod 212 of the brake block 21, therefore the push button 2 and the slide 1 cannot be moved.

I claim:

1. A safety control switch comprising a push button ignition switch for controlling gas flow and ignition in a gas-fired ignition gun, said push button ignition switch comprising a slide moved in a track of the housing of the gas-fired ignition gun, a push button supported on a compression spring in a through hole on said slide, a contact metal spring plate and a brake block fixed to said push button, wherein a locking device is mounted on the housing of the gas-fired ignition gun and moved relative to said brake block between a first position to stop said push button and said slide from operation and a second position to let said push button and said slide be operated.

2. The safety control switch of claim 1 wherein said locking device is comprised of a finger rod for moving by hand, and a locking block fixed to said finger rod and moved by it between said first position and said second position.

3. The safety control switch of claim 1 wherein said locking device has two opposite ends connected to the housing of the gas-fired ignition gun by a respective slip joint.

* * * * *